US010927587B2

(12) United States Patent
Lee et al.

(10) Patent No.: US 10,927,587 B2
(45) Date of Patent: Feb. 23, 2021

(54) REFRIGERATOR

(71) Applicant: LG Electronics Inc., Seoul (KR)

(72) Inventors: Heejun Lee, Seoul (KR); Dongjeong Kim, Seoul (KR); Seungyoon Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 170 days.

(21) Appl. No.: 16/201,249

(22) Filed: Nov. 27, 2018

(65) Prior Publication Data

US 2019/0162006 A1 May 30, 2019

(30) Foreign Application Priority Data

Nov. 27, 2017 (KR) ..... 10-2017-0159253

(51) Int. Cl.
*E05F 15/619* (2015.01)
*F25D 23/02* (2006.01)
*E05F 15/73* (2015.01)

(52) U.S. Cl.
CPC ..... *E05F 15/619* (2015.01); *E05F 15/73* (2015.01); *F25D 23/02* (2013.01); *F25D 23/028* (2013.01); *E05Y 2201/422* (2013.01); *E05Y 2201/434* (2013.01); *E05Y 2201/46* (2013.01); *E05Y 2201/722* (2013.01); *E05Y 2900/31* (2013.01)

(58) Field of Classification Search
CPC ..... E05F 15/619; E05F 15/70; F25D 23/02; F25D 23/028
USPC ..... 49/334–336
See application file for complete search history.

(56) References Cited

U.S. PATENT DOCUMENTS 10,132,555 B2 * 11/2018 Yasaka ..... E05F 15/614
2010/0018240 A1 * 1/2010 Hecht ..... E05F 15/73 62/449
2017/0260794 A1 * 9/2017 Son ..... E05F 15/614

FOREIGN PATENT DOCUMENTS

JP 2015055130 3/2015
WO WO-2006006707 A1 * 1/2006 ..... F25D 23/028
WO WO-2016175562 A1 * 11/2016 ..... F25D 23/02

OTHER PUBLICATIONS

JP 2015-055130 English Translation (Year: 2015).*

* cited by examiner

*Primary Examiner* — Kyle R Grabowski
(74) *Attorney, Agent, or Firm* — Fish & Richardson P.C.

(57) ABSTRACT

A refrigerator comprises: a cabinet including a storage compartment, a door opening or closing the storage compartment, a door opening device including a push rod moving from an initial position to a door opening position for opening the door and a motor providing power to the push rod, and a controller controlling the motor. The controller allows the motor to rotate at a first opening speed for opening the door of the refrigerator. The controller changes a rotation speed of the motor to a second opening speed lower than the first opening speed before the push rod contacts the door of the refrigerator or the cabinet.

15 Claims, 12 Drawing Sheets

REFRIGERATOR

CROSS-REFERENCE TO RELATED APPLICATIONS

This application claims the benefit of the Korean Patent Application No. 10-2017-0159253 filed on Nov. 27, 2017, which is hereby incorporated by reference as if fully set forth herein.

BACKGROUND

The present disclosure relates to a refrigerator.

A refrigerator is a home appliance that can keep objects such as food in a storage compartment provided in a cabinet at a low temperature. The storage compartment may be surrounded by an insulation wall such that the internal temperature of the storage compartment is maintained at a temperature lower than an external temperature.

The storage compartment may be referred to as a refrigerating compartment or a freezing compartment according to the temperature range of the storage compartment.

A user may open and close the storage compartment using a door. The user opens the door in order to put objects into the storage compartment or take objects out of the storage compartment. In some examples, the door is rotatably provided on the cabinet and a gasket is provided between the door and the cabinet.

In some cases, in a state of closing the door, the gasket is closely adhered between the door and the cabinet to prevent leakage of cool air from the storage compartment. As adhesion force of the gasket increases, the effect of preventing leakage of cool air may increase.

In order to increase adhesion force of the gasket, the gasket may be formed of, for example, a rubber magnet or a magnet may be provided in the gasket. However, if adhesion force of the gasket increases, a large force may be required to open the door.

Recently, refrigerators having an auto closing function have been provided. For example, an auto closing function refers to a function for automatically closing the door of the refrigerator using adhesion force and magnetic force of the gasket and elastic force of a spring when the door of the refrigerator is slightly opened.

In some examples, the auto closing function refers to a function for preventing the door of the refrigerator from being automatically opened even when the refrigerator is slightly tilted forward.

In some cases, the refrigerators may require a large force to open a door because a user may pull the door with force larger than adhesion force and magnetic force of a gasket and elastic force of a spring.

Recently, a door opening device for automatically opening a door has been proposed.

An opening device for opening a door of a refrigerator has been disclosed in Japanese patent laid-open publication No. 2015-55130 which is the prior art reference.

The opening device includes a first protrusion part which pushes out a first door, a second protrusion part which pushes out a second door, a motor which is rotatable in a forward/rearward direction, and a plurality of sensing means which sense states of the first and second protrusion parts.

In the prior art reference, the states of the first and second protrusion parts are determined based on an turn-on/off state of each of the plurality of sensing means.

However, in the prior art reference, since the plurality of sensing means sense the states of the protrusion parts, the number of parts increase, and since the plurality of sensing means should be installed without interference on a motor or a gear, an installation structure is complicated.

Moreover, in the prior art reference, since the motor is controlled in order for the protrusion parts to perform a uniform acceleration motion for opening a door, noise occurs in a process where the protrusion part contacts the door at an initial stage of the motion.

Moreover, in the prior art reference, since a velocity of the protrusion part increases gradually and then is the maximum immediately before a protrusion end, when the protrusion part stops immediately, collision noise occurs in a process where the door again contacts the protrusion part after an inertial rotation of the door at a time when opening of the door is completed.

SUMMARY

The present embodiment provides a refrigerator which accurately controls a position of a push rod for opening a door without a sensor for sensing the position of the push rod.

The present embodiment provides a refrigerator in which, when a push rod is unloaded for opening a door, noise occurring in a process where the push rod contacts the door or a cabinet is minimized.

The present embodiment provides a refrigerator which removes noise caused by rattling of a refrigerator door at a time when opening of the refrigerator door is completed.

The present embodiment provides a refrigerator which removes noise occurring when a push rod contacts a door in a state where the push rod is spaced apart from the door, in a process where the push rod returns to an initial position.

The present embodiment provides a refrigerator which moves a push rod to an initial position even without a sensor for determining a position of the push rod, when power for the refrigerator is applied or when the power is applied after the power is cut off.

The refrigerator includes: a cabinet including a storage compartment; a door opening or closing the storage compartment; a door opening device including a push rod, moving from an initial position to a door opening position for opening the door, and a motor providing power to the push rod; and a controller controlling the motor.

The controller may allow the motor to rotate at a first opening speed for opening the door of the refrigerator, The controller may change a rotation speed of the motor to a second opening speed lower than the first opening speed before the push rod contacts the door of the refrigerator or the cabinet.

The controller may increase the rotation speed of the motor from the second opening speed to a third opening speed after the push rod contacts the door of the refrigerator or the cabinet.

The refrigerator may further include a rotation sensing unit sensing number of rotations of the motor.

While the motor is rotating at the first opening speed, when accumulated number of rotations of the motor reaches a first reference rotation number, the controller may change the rotation speed of the motor to the second opening speed.

When the motor rotates at the second opening speed and a predetermined time elapses, the controller may increase the rotation speed of the motor to the third opening speed.

The controller may decrease the rotation speed of the motor before the push rod moves to the door opening position.

When the accumulated number of rotations of the motor reached a second reference rotation number larger than the first reference rotation number after the motor starts to operate, the controller may decrease the rotation speed of the motor.

When the accumulated number of rotations of the motor reaches a third reference rotation number larger than the second reference rotation number after the motor starts to operate, the controller may determine that the push rod moves to the door opening position, and may stop the rotation of the motor.

The third opening speed may be set higher than the first opening speed.

In order to move the push rod from the door opening position to an initial position, the controller may rotate the motor at a first closing speed, and then, may rotate the motor at a second closing speed faster than the first closing speed.

The controller may decrease the rotation speed of the motor before the push rod moves to the initial position.

When the accumulated number of rotations of the motor reaches a first closing reference number, the controller may change the rotation speed of the motor from the first closing speed to the second closing speed.

The controller determines whether the push rod reaches a reference position, and when the push rod reaches the reference position, the controller may change the rotation speed of the motor.

When number of rotations of the motor for a unit time is equal to or less than a stop reference number, the controller may determine that the push rod moves to the reference position.

When accumulated number of rotations of the motor reaches a predetermined rotation number after the motor rotates in an opposite direction, the controller may determine that the push rod moves to the initial position, and stops the motor.

When power is applied to the refrigerator, the controller may rotate the motor in one direction which is a direction in which the push rod moves from the door opening position to the initial position. When it is determined that the push rod reaches a reference position, the controller may change a rotation direction of the motor to another direction, and when it is determined that the push rod reaches the initial position, the controller may stop the motor.

In another aspect of the present invention, there is provided A refrigerator including: a cabinet including a storage compartment; a refrigerator door opening or closing the storage compartment; a door opening device including a push rod, moving from an initial position to a door opening position for opening the refrigerator door, and a motor providing power to the push rod; and a controller controlling the motor, wherein in order to move the push rod from the door opening position to an initial position, the controller rotates the motor at a first closing speed, and then, rotates the motor at a second closing speed faster than the first closing speed.

The controller may decrease the rotation speed of the motor before the push rod moves to the initial position.

In another aspect of the present invention, there is provided a refrigerator including: a cabinet including a storage compartment; a refrigerator door opening or closing the storage compartment; a door opening device including a push rod, moving from an initial position to a door opening position for opening the refrigerator door, and a motor providing power to the push rod; and a controller controlling the motor. When power is applied to the refrigerator, the controller may rotate the motor in one direction which is a direction in which the push rod moves from the door opening position to the initial position. When it is determined that the push rod reaches a reference position, the controller may change a rotation direction of the motor to another direction, and when it is determined that the push rod reaches the initial position, the controller may stop the motor.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION OF THE DISCLOSURE

Figure 1:
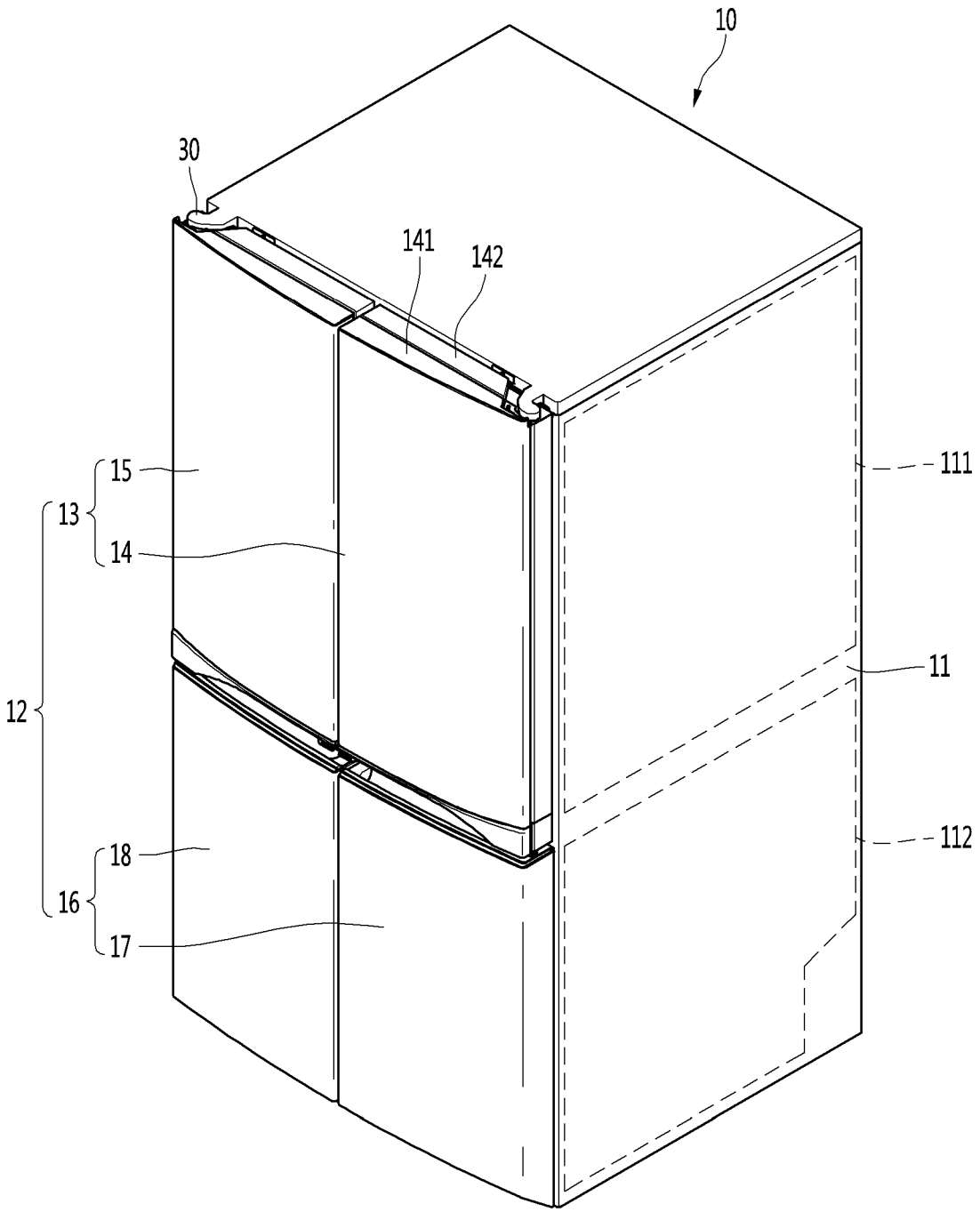
FIG. 1 is a perspective view of a refrigerator according to an embodiment of the present invention.
Figure 2:
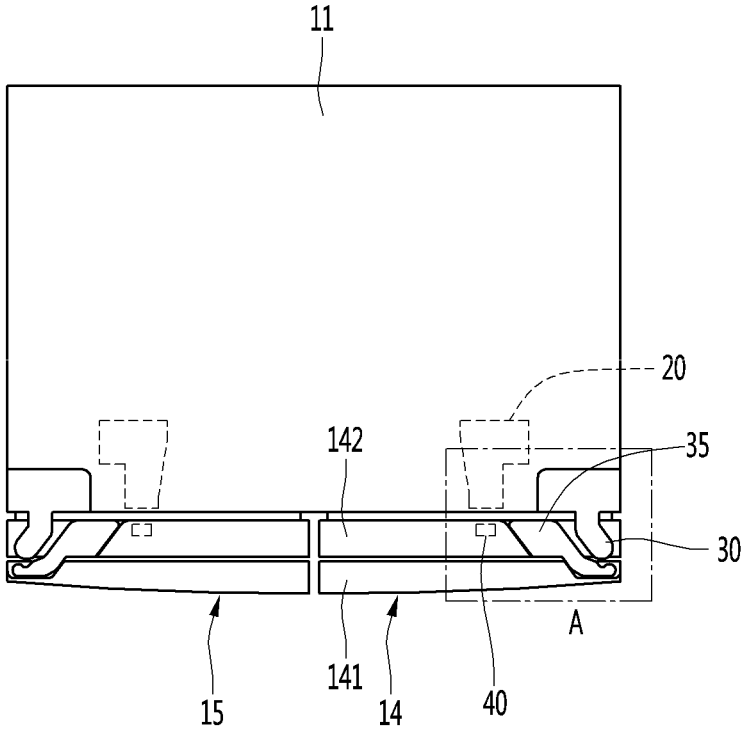
FIG. 2 is a perspective view illustrating an example where a door opening device included in a cabinet according to an embodiment of the present invention.

FIG. 1 is a perspective view of a refrigerator 10 according to an embodiment of the present invention, and FIG. 2 is a perspective view illustrating an example where a door opening device is included in a cabinet according to an embodiment of the present invention.

Referring to FIGS. 1 and 2, the refrigerator 10 according to an embodiment of the present invention may include a cabinet 11 which forms a storage compartment and a door 12 which opens or closes the storage compartment.

The storage compartment may include, for example, a cooling compartment 111 and a freezer compartment 112. However, the present embodiment is not limited thereto, and the cooling compartment 111 may be located over the freezer compartment 112. Based on a type of a refrigerator, the cooling compartment 111 and the freezer compartment 112 may be disposed laterally, or the freezer compartment 112 may be located over the cooling compartment 111.

The door 12 may include a cooling compartment door 13 for opening or closing the cooling compartment 111 and a freezer compartment door 16 for opening or closing the freezer compartment 112.

The cooling compartment door 13 may include a pair of doors 14 and 15 which are disposed laterally. The freezer compartment door 16 may include a pair of doors 17 and 18 which are disposed laterally. Also, the door 12 may be rotatably connected to the cabinet 11 by a hinge 30.

However, in the present embodiment, the number of the cooling compartment doors 13 and the number of the freezer compartment doors 16 are not limited in disposition.

For example, the cooling compartment door 13 may include a first cooling compartment door 13 and a second cooling compartment door 15.

The first cooling compartment door 14 may include, for example, an inner door 142 which is closed adhered to a front surface of the cabinet 11 and an outer door 141 which is disposed on the front surface of the inner door 142.

A separate accommodation space distinguished from the storage compartment may be provided between the inner door 142 and the outer door 141 or in the inner door 142.

Moreover, the first cooling compartment door 14 may be a pivotable door which is rotatably provided through a first hinge 30. Also, the outer door 141 may be rotatably connected to the inner door 142 through a second hinge 35.

That is, the first hinge 30 may be provided to connect the inner door 142 to the cabinet 11, and the second hinge 35 may be provided to connect the inner door 142 to the outer door 141.

Therefore, the outer door 141 may rotate about a rotational shaft 37 (see FIG. 3) of the second hinge 35 to open the accommodation space. Also, the first cooling compartment door 14 including the inner door 142 and the outer door 141 may rotate about a rotational shaft 32 of the first hinge 30 to open the cooling compartment 111.

However, in the present embodiment, a structure of the first cooling compartment door 14 is not limited, and the first cooling compartment door 14 may be a single door.

The refrigerator 10 may further include a door opening device 20 for automatically opening the door 12.

Hereinafter, an example where the door opening device 20 opens the first cooling compartment door 14 will be described, and the second cooling compartment door 15 or the freezer compartment door 13 may be automatically opened by using the door opening device 20.

The door opening device 20 may be installed in, for example, the cabinet 11 to open the first cooling compartment door 14. As another example, the door opening device 20 may be included in the door 12.

The refrigerator 10 may further include a reed switch assembly 40 for sensing passive opening of the first cooling compartment door 14. The first cooling compartment door 14 being passively opened may denote that a user opens the first cooling compartment door 14.

The reed switch assembly 40 may be included in, for example, the first cooling compartment door 14. However, in a case where the door opening device 20 is included in the first cooling compartment door 14, the reed switch assembly 40 may be included in the cabinet 11.

The door opening device 20 may be driven under a predetermined condition or state, and the door 12 may be automatically opened according to driving of the door opening device 20. Therefore, a force necessary for user's opening the door is considerably reduced or is not needed.

For example, when the approach of the user is recognized, the user pushes a specific button, or the user inputs an opening command through a touch type input unit, the door opening device 20 may operate.

Hereinafter, the door opening device 20 will be described in detail.

Figure 3:
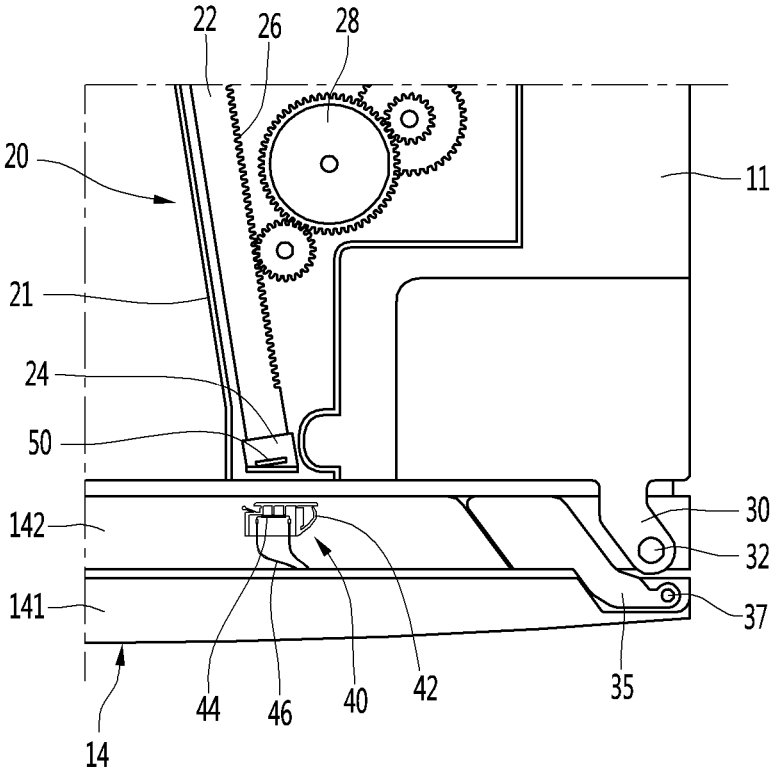
FIG. 3 is an enlarged view of a portion A of FIG. 2.
Figure 4:
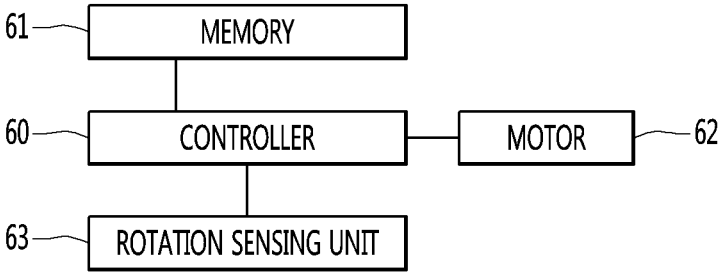
FIG. 4 is a block diagram of a refrigerator according to an embodiment of the present invention.

FIG. 3 is an enlarged view of a portion A of FIG. 2, and FIG. 4 is a block diagram of a refrigerator according to an embodiment of the present invention.

Referring to FIGS. 3 and 4, the door opening device 20 may rotate the door 12 by pushing the door 12 which is to be opened, thereby automatically opening the door 12.

The door opening device 20 may be disposed on, for example, an upper side of the cabinet 11.

The door opening device 20 may be accommodated into an internal space of the cabinet 11, or may be installed on a top of the cabinet 11.

The door opening device 20 may include a housing 21, a motor 62, a power transfer device 28, and a push rod 22.

The power transfer device 28 may include, for example, a plurality of gears, and the plurality of gears may be rotatably installed in the housing 21. The push rod 22 may be installed so as to enable a rectilinear motion in the housing 21.

In FIG. 3, a state where the push rod 22 is loaded into the housing 21 and a state where the first cooling compartment door 14 is closed is illustrated for example.

The push rod 22 may include a rack gear 26. The rack gear 26 may be engaged with one of the plurality of gears. Also, a rack cover 24 including a rubber material may be coupled to an end of the push rod 22.

The rack cover 24 prevents the push rod 22 from directly contacting the first cooling compartment door 14.

As another example, a rotational member (not shown) capable of being rotated by a hinge may be provided in the end of the push rod 22. When the push rod 22 is moving, the rotational member may maintain a state of contacting the first cooling compartment door 14, thereby preventing the first cooling compartment door 14 from being damaged by sliding of the first cooling compartment door 14 and the rotational member.

The push rod 22 may be provided in a rectilinear rack form which extends on a straight line. Since the push rod 22 is provided in the rectilinear rack form, the first cooling compartment door 14 may rotate with a relatively small force.

When seen from an upper side of the cabinet 11, the push rod 22 may be disposed in a diagonal form on a front surface of the cabinet 11. For example, the push rod 22 may pass by the rotational shaft 32 of the first hinge 30, and thus, an angle between the push rod 22 and a line parallel to the front surface of the cabinet 11 may be an obtuse angle.

According to such disposition, by using the push rod 22 having a short length, an opening angle of the door may increase. Accordingly, a size of the door opening device 20 is reduced, and thus, an upper space of the cabinet 11 is efficiently used.

On the other hand, if the door opening device 20 is disposed in the first cooling compartment door 14, the push rod 22 may pass by a hinge shaft 32 of the first hinge 30, and thus, an angle between the push rod 22 and the line parallel to the front surface of the cabinet 11 may be an acute angle.

The motor 62 may be a motor capable of rotating in two directions.

Based on a first rotation direction of the motor 62, a rotational force of the motor 62 may be transferred to the push rod 22 by a plurality of gears, and thus, the push rod 22 may move in a direction protruding from the housing 21 so as to open the first cooling compartment door 14.

On the other hand, based on a second rotation direction of the motor 62, the rotational force of the motor 62 may be transferred to the push rod 22 by the plurality of gears, and thus, the push rod 22 may be loaded into the housing 21.

In the present embodiment, a position which waits for a door opening command in a state of closing the first cooling compartment door 14 may be referred to as an initial position of the push rod 22. Also, a position of the push rod 22 at a position at which automatic opening of the first cooling compartment door 14 is completed by the push rod 22 may be referred to as a door opening position.

Moreover, a position which is checked for moving the push rod 22 to the initial position may be referred to as a reference position.

In this case, in a state where the first cooling compartment door 14 is closed, the push rod 22 may be spaced apart from a rear surface of the first cooling compartment door 14 at the initial position of the push rod 22.

In the present embodiment, the housing 21 may include a stopper 22*a* (see FIG. 11) which contacts the push rod 22 in a state where the push rod 22 has moved to the reference position. The stopper 22*a* (see FIG. 11) may be used as an element for sensing that the push rod 22 has moved to the reference position.

The push rod 22 may move from the initial position to the door opening position, based on the first direction rotation of the motor 62. Also, the push rod 22 may move from the door opening position to the reference position, based on the second direction rotation of the motor 62. Also, the push rod 22 may move from the reference position to the initial position, based on the first direction rotation of the motor 62.

The refrigerator 10 may further include a magnetic field generation device 50 which is used for sensing passive opening of the first cooling compartment door 14. The magnetic field generation device 50 may be, for example, a magnet.

The reed switch assembly 50 may include a case 42, a reed switch 44, and a wire 46. The reed switch 44 may include a vessel, which forms a certain accommodation space, and a pair of reeds disposed inside the vessel.

The reed switch 44 may be turned on/off based on an intensity of a magnetic field generated by the magnetic field generation device 50.

For example, if the intensity of the magnetic field is equal to or greater than a certain level, the reed switch 44 may be turned on, and if the intensity of the magnetic field is less than the certain level, the reed switch 44 may be turned off (or a reverse case is possible).

The wire 46 may extend to the outside of the case 42 and may be connected to a controller 60. For example, the wire 46 may extend to an inner side of the outer door 141.

The magnetic field generation device 50 may be installed in the door opening device 20. For example, the magnetic field generation device 50 may be installed in one end of the push rod 22.

If a rack cover 24 is coupled to the push rod 22, the magnetic field generation device 50 may be provided in an end of the push rod 22 or the rack cover 24. If the rotational member is coupled to the push rod 22, the magnetic field generation device 50 may be provided in the end of the push rod 22 or the rotational member.

The magnetic field generation device 50 and the reed switch 44 may be disposed adjacent to each other. For example, in a state where the first cooling compartment door 14 is closed, the magnetic field generation device 50 and the reed switch 44 may be disposed to face each other.

In a state where the reed switch 44 is located adjacent to the magnetic field generation device 50, the reed switch 44 may recognize the magnetic field generated by the magnetic field generation device 50, and thus, may be in a state (which may be referred to as a turn-on state) where a pair of reeds are bonded to each other.

On the other hand, if the magnetic field generation device 50 is spaced apart from the reed switch 44 by a certain distance, the reed switch 44 cannot recognize the magnetic field generated by the magnetic field generation device 50, and thus, may be in a state (may be referred to as a turn-off state) where the pair of reeds are spaced apart from each other.

The controller 60 may determine whether the first cooling compartment door 14 is passively opened, based on a state of the reed switch 44. For example, when the reed switch 44 in a turn-off state, the controller 60 may determine that the first cooling compartment door 14 passively opened by the user.

The refrigerator 10 may further include a rotation sensing unit 63 for sensing a rotating state of the motor 62. The controller 60 may control the motor 62, based on information about the number of rotations sensed by the rotation sensing unit 63.

The controller 60 may indirectly determine a position of the push rod 22, based on the information sensed by the rotation sensing unit 63.

The rotation sensing unit 63 may be, for example, an encoder for sensing the number of rotations of the motor 62. Alternatively, the rotation sensing unit 63 may sense a rotation of one of the plurality of gears.

The encoder may output N number of pulses when the motor 62 rotates once, and the controller 60 may determine the number of rotations of the motor 62, based on the accumulated number of pulses of the motor 62. As another example, the controller 60 may include a function of sensing the number of rotations of the motor 62.

The controller 60 may sense the number of rotations of the motor 62 or the gear without a separate sensor for sensing a position of the push rod 22 and may control the position of the push rod 22.

The refrigerator 10 may further include a memory 61 which stores information about the number of rotations of the motor 62 necessary for the push rod 22 moving from the initial position to the door opening position.

Hereinafter, an operation of the door opening device 20 will be described.

In the present embodiment, a logic for controlling the door opening device 20 may include an initialization logic, a door opening logic, a normal return logic, and an urgent return logic.

First, the initialization logic will be described.

Figure 5:
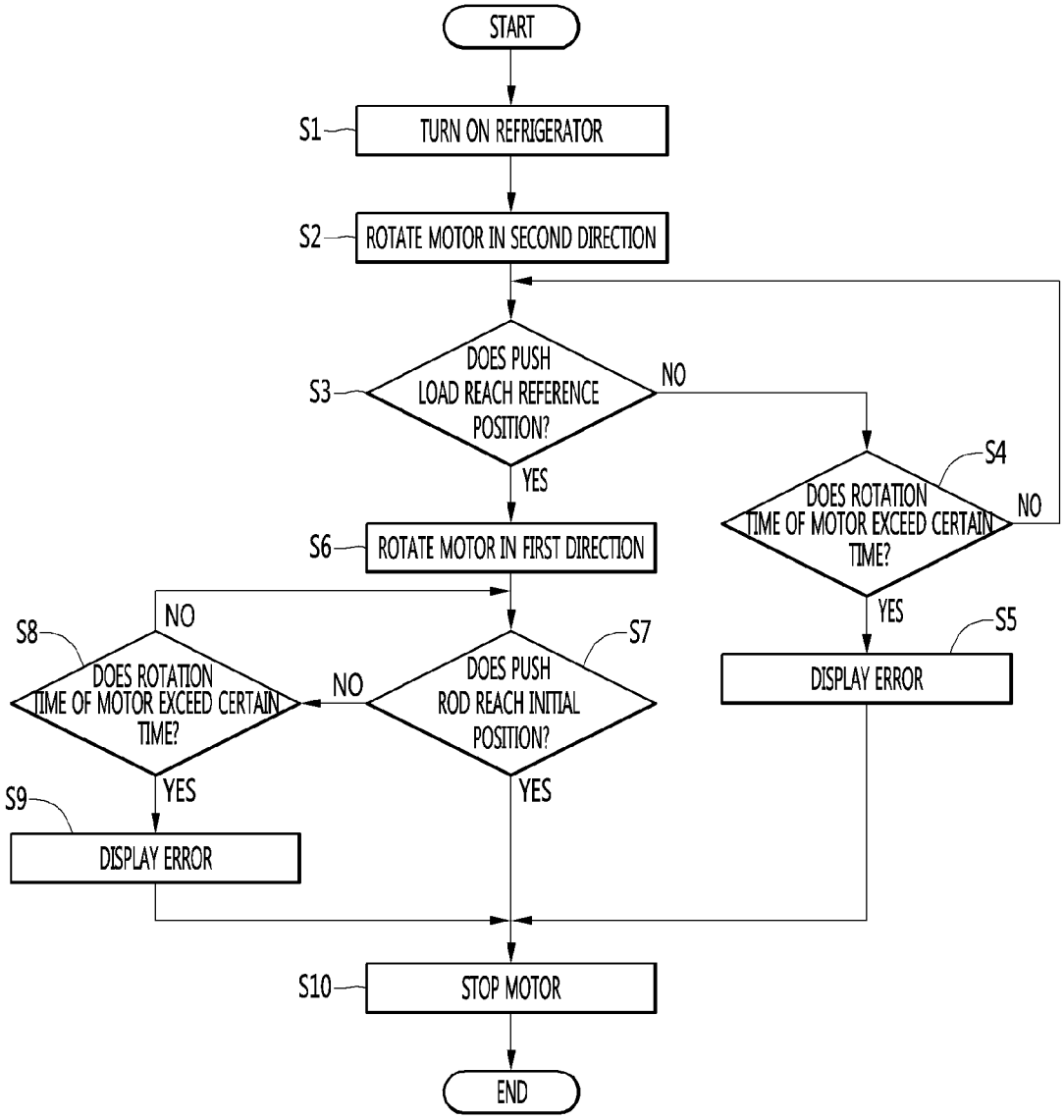
FIG. 5 is a flowchart illustrating an initialization logic of a door opening device according to an embodiment of the present invention.

FIG. 5 is a flowchart illustrating an initialization logic of a door opening device according to an embodiment of the present invention.

Referring to FIG. 5, the initialization logic may be performed when power is again applied to the refrigerator after a user cuts off the power applied to the refrigerator or the power of the refrigerator is cut off by a power cut.

In the present embodiment, the controller 60 may control a position of the push rod 22 without a separate sensor, but when the power is again applied after the power of the refrigerator 10 is cut off, a current position of the push rod 22 cannot be checked.

Therefore, the controller 60 may perform the initialization logic for moving the push rod 22 to the initial position.

For example, when the power of the refrigerator is turned on (S1), the controller 60 may rotate the motor 62 in a second direction (S2).

Based on the second direction rotation of the motor 22, the push rod 22 may move in a direction getting closer to the stopper 22*a* (see FIG. 11) of the housing 21.

While the motor 62 is rotating in the second direction, the controller 60 may determine whether the push rod 22 reaches the reference position (S3).

For example, while the motor 62 is rotating in the second direction, the number of rotations of the motor 62 may be sensed.

When the push rod 22 contacts the stopper 22*a* (see FIG. 11) of the housing 21, the push rod 22 cannot move. If the push rod 22 cannot move, the motor 62 cannot rotate, and thus, the number of rotations of the motor 62 does not increase.

Therefore, if the number of rotations of the motor 62 for a unit time is equal to or less than the stop reference number, the controller 60 may determine that the push rod 22 has moved to the reference position and may rotate the motor 62 in a first direction opposite to the second direction (S6).

On the other hand, when it is determined (S3) that the number of rotations of the motor 62 for the unit time is greater than the stop reference number, the controller 60 may determine whether a rotation time of the motor 62 exceeds a certain time (S4).

When it is determined (S4) that the rotation time of the motor 62 does not exceed the certain time, the controller 60 may return to step S3.

On the other hand, when it is determined (S4) that the rotation time of the motor 62 exceeds the certain time, a display unit (not shown) may display an error (S5), and the motor 62 may stop (S10).

That is, when the motor 62 rotates in the second direction for a certain time or more but the push rod 22 does not reach the reference position, the controller 60 may determine that a state of the door opening device 20 is an abnormal state and may stop the motor 62, and the display unit may display an error.

Figure 11:
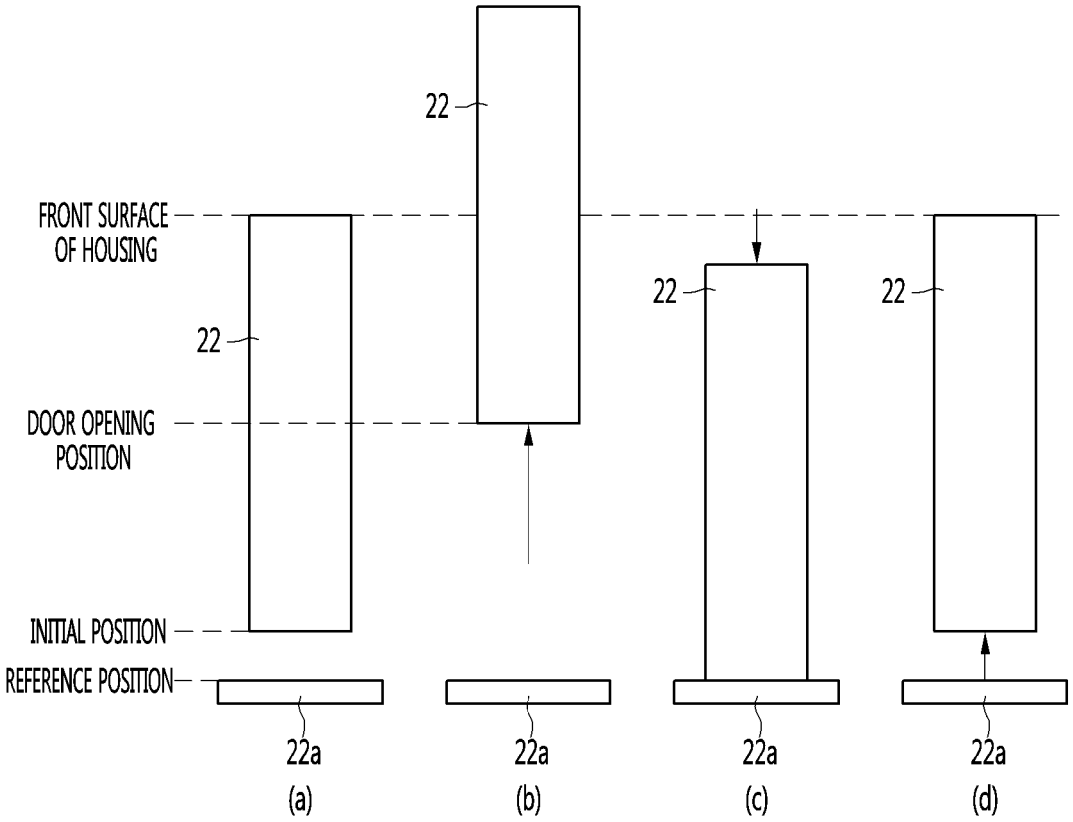
FIG. 11 is a diagram illustrating a position of a push rod until the push rod returns from a door opening position to an initial position.

When the motor 62 rotates in the first direction, the push rod 22 may move in a direction deviating from the stopper 22*a* (see FIG. 11).

While the motor 62 is rotating in the first rotation, the controller 60 may determine whether the push rod 22 reaches the initial position (S7).

The number of rotations necessary for the push rod 22 moving from the reference position to the initial position may be predetermined and stored in the memory 61. Therefore, when the accumulated number of rotations reaches a predetermined rotation number in a case where the motor 62 rotates in the first direction, the controller 60 may determine that the push rod 22 has moved to the initial position and may stop the motor 62 (S10).

On the other hand, when it is determined (S7) that the push rod 22 does not reach the initial position, the controller 60 may determine whether the rotation time of the motor 62 exceeds the certain time (S8).

When it is determined (S8) that the rotation time of the motor 62 does not exceed the certain time, the controller 60 may return to step S7.

On the other hand, when it is determined (S8) that the rotation time of the motor 62 exceeds the certain time, the display unit (not shown) may display an error (S9), and the motor 62 may stop (S10).

That is, when the motor 62 rotates in the first direction for a certain time or more but the push rod 22 does not reach the initial position, a current state may be a state where a rotational force of the motor 62 is not transferred to the push rod 22 or the push rod 22 cannot move due to an obstacle. Accordingly, the controller 60 may determine that a state of the door opening device 20 is an abnormal state and may stop the motor 62, and the display unit may display an error.

According to the present embodiment, when the power is applied to the refrigerator, the controller 60 may move the push rod 22 to the reference position and then may move the push rod 22 to the initial position, and thus, the push rod 22 may stand by at the initial position.

Next, the door opening logic will be described.

Figure 6:
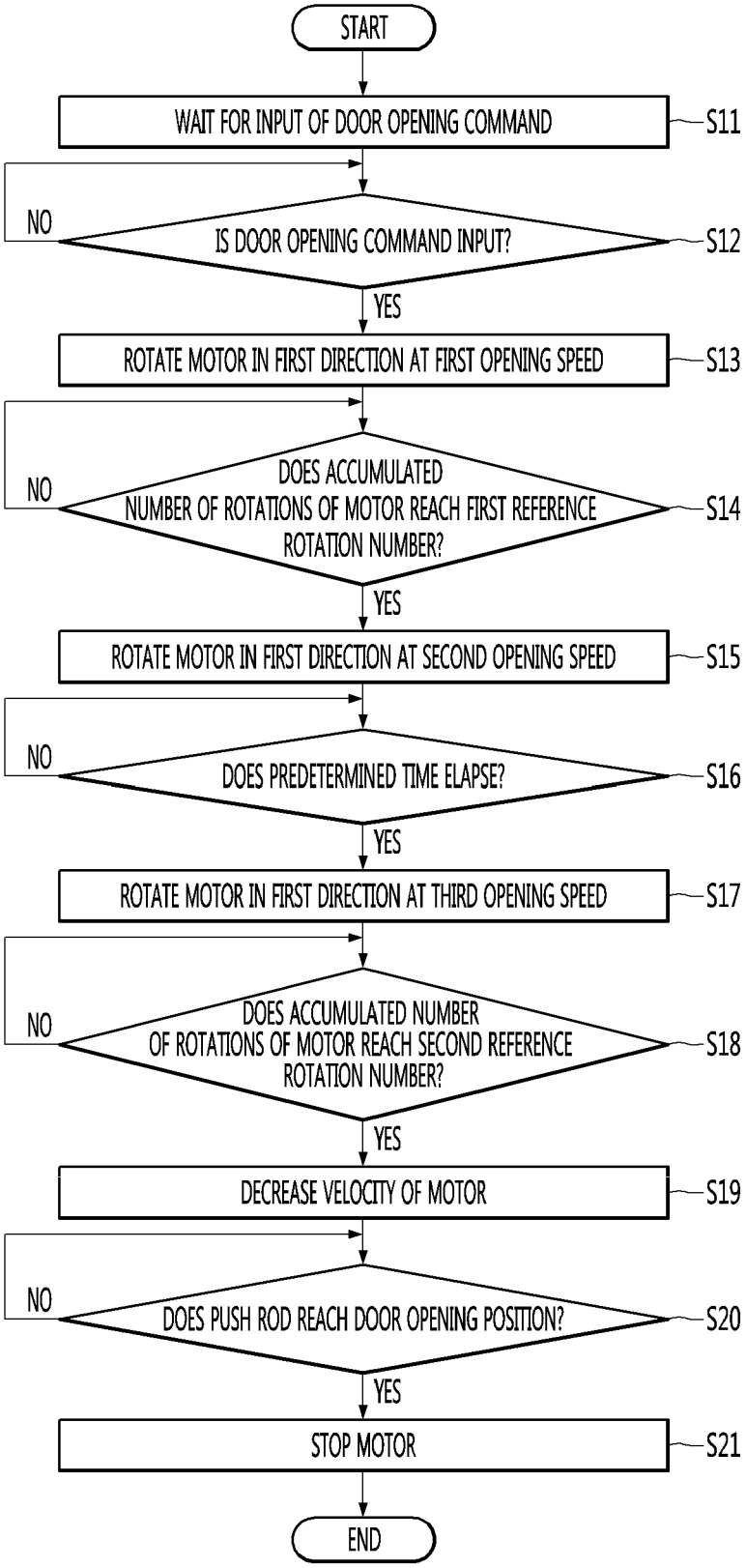
FIG. 6 is a flowchart for describing a logic for opening a door according to an embodiment of the present invention.
Figure 7:
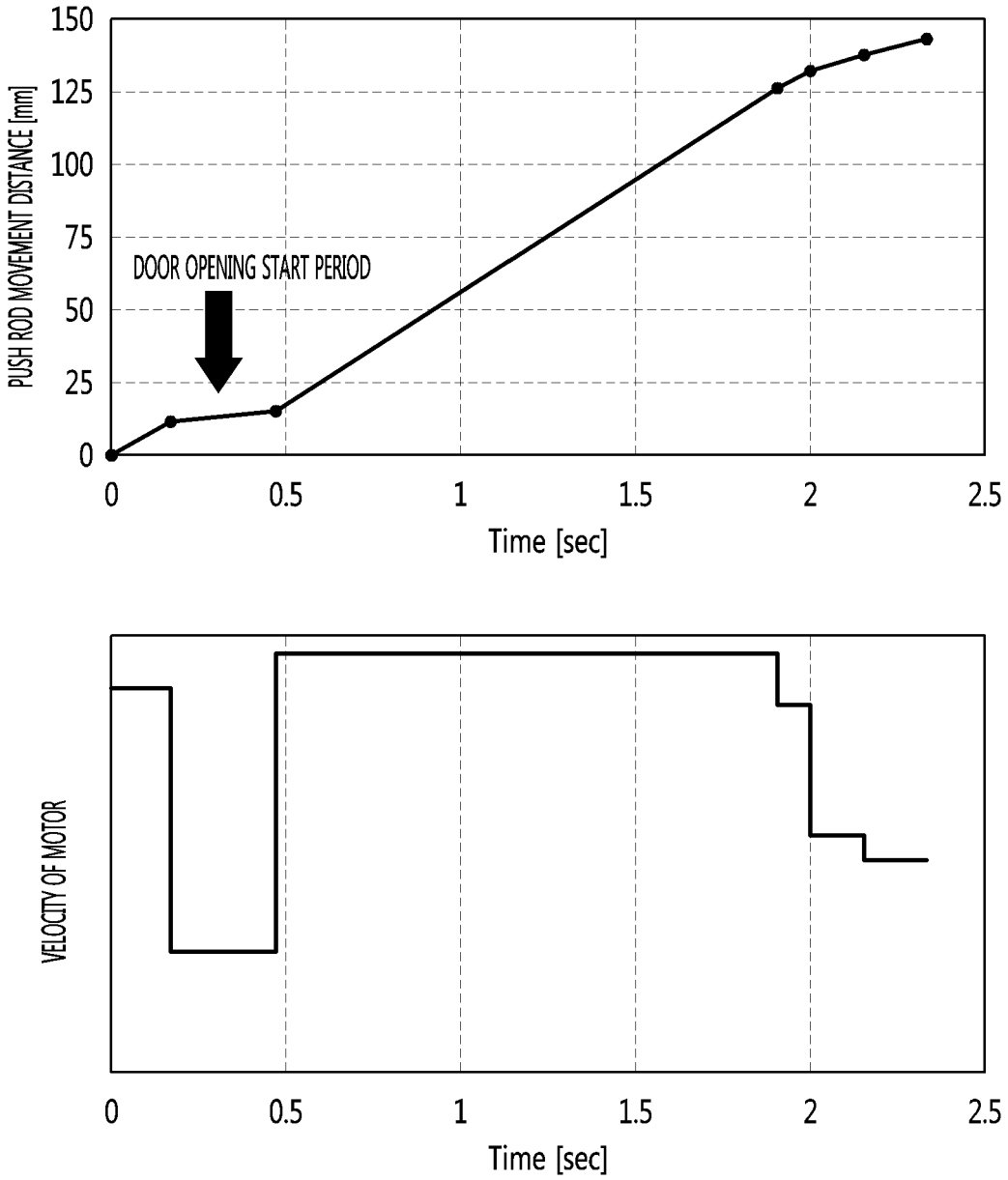
FIG. 7 is a diagram illustrating a rotation speed of a motor and a movement distance of a push rod in a process of opening a door.
Figure 8:
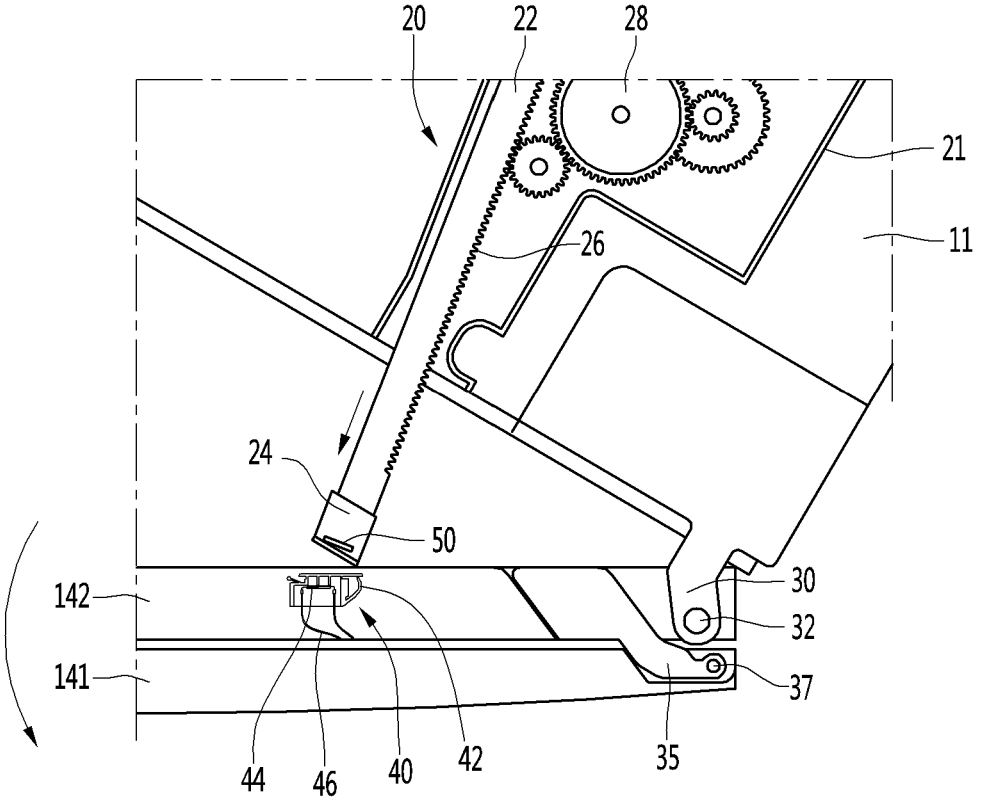
FIG. 8 is a diagram illustrating a state where a door is opened.

FIG. 6 is a flowchart for describing a logic for opening a door according to an embodiment of the present invention, FIG. 7 is a diagram illustrating a rotation speed of a motor and a movement distance of a push rod in a process of opening a door, and FIG. 8 is a diagram illustrating a state where a door is opened.

Referring to FIGS. 6 to 8, in a state where the refrigerator 10 is turned on, as described above, the controller 60 may wait for an input of a door opening command in a state where the push rod 22 is located at the initial position (S11).

When it is determined that the door opening command is input (S12), the controller 60 may control the motor 62 in order for the motor 62 to rotate in the first direction (S13), for moving the push rod 22 from the initial position to the door opening position.

At this time, the controller 60 may control the motor 62 in order for the motor 62 rotate at a first opening speed.

Since the push rod 22 is spaced apart from the door 12, the first opening speed may be set in order for the push rod 22 to quickly approach the door 12.

When the motor 62 rotates in the first direction, the plurality of gears may transfer a first direction rotational force of the motor 62 to the push rod 22, and thus, the push rod 2 may move in a direction getting closer to the door 12.

Moreover, the controller 60 may determine whether the accumulated number of rotations of the motor 62 reaches a first reference rotation number (S14).

When it is determined (S14) that the accumulated number of rotations of the motor 62 reaches the first reference rotation number, the controller 60 may control the motor 62 in order for the motor 62 to rotate at a second opening speed (S15).

In this case, the second opening speed may be set lower than the first opening speed. However, the present embodiment is not limited thereto, and the second opening speed may be set as a speed equal to or lower than one-third (⅓) of the first opening speed.

When the push rod 22 contacts the door 12 while the motor 62 is rotating at the first opening speed (a relatively high speed), collision noise occurs when the push rod 22 contacts the door 12.

Therefore, in the present embodiment, in order to minimize noise caused by a collision of the push rod 22 and the door 12 at an initial operation stage of the push rod 22, the controller 60 may reduce a velocity of the motor 62 before the push rod 22 contacts the door 12.

To this end, the first reference rotation number may be set as the number of rotations when the push rod 22 is located at a certain point before the push rod 22 contacts the door 12.

While the motor 62 is rotating at the second opening speed, the controller 60 may determine whether a predetermined time elapses (S16).

The predetermined time may be a time for allowing the push rod 22 to completely contact the door 12. As in FIG. 7, while the predetermined time elapses, the push rod 22 may contact the door 12, and thus, the door 12 may start to be opened.

When it is determined (S16) that the predetermined time elapses after the motor 62 rotates at the second opening speed, the controller 60 may increase a rotation speed of the motor 62. That is, the controller 60 may control the motor 62 in order for the motor 62 to rotate at a third opening speed (S17).

As the rotation speed of the motor 62 becomes slower, an opening time of the door 12 may increase. When the opening time of the door 12 increases, a time for waiting for opening of the door 12 may increase, causing dissatisfaction of a user.

Therefore, in the present embodiment, in a state where the push rod 22 contacts the door 12, the controller 60 may increase the rotation speed of the motor 62 so as to quickly open the door 12. However, the present embodiment is not limited thereto, and the third opening speed may be set as a speed equal to or faster than the first opening speed.

Based on the first direction rotation of the motor 62, the push rod 22 may push the door 12 to allow the door 12 to rotate.

While the motor 62 is rotating at the third opening speed, the controller 60 may determine whether the accumulated number of rotations of the motor 62 reaches a second reference rotation number (S18). At this time, the number of rotations of the motor 62 may be continuously sensed and accumulated after the motor 62 starts to rotate.

When it is determined (S18) that the accumulated number of rotations of the motor 62 reaches the second reference rotation number, the controller 60 may decrease the rotation speed of the motor 62 (S19).

For example, while the motor 62 is rotating at the third opening speed (a relatively high speed), if the controller 60 stops the motor 62 immediately after it is determined that the push rod 22 reaches the door opening position, the push rod 22 may immediately stop.

On the other hand, since the door 12 is rotated by a virtual pressure of the push rod 22, even though the push rod 22 stops, the door 12 may further rotate at a certain angle in a counterclockwise direction with respect to FIG. 8, based on an inertial force.

When the door 12 is further rotated at the certain angle by the inertial force in a state where the push rod 22 stops, the door 12 may be spaced apart from the push rod 22.

A rotation angle of the door 12 based on the inertial force is not large, and the door 12 may again rotate in a clockwise direction, based on a load thereof and may contact the push rod 22.

As described above, the door 12 may inertially rotate according to the stop of the push rod 22 (for example, the door 12 may be spaced apart from the push rod 22), and then, the door 12 may rotate in an opposite direction. For this reason, noise or rattling can occur in a process of contacting the push rod 22, causing dissatisfaction of a user.

Therefore, in the present embodiment, by reducing a rotation speed of the motor 62 before the push rod 22 moves to the door opening position, an inertial rotation of the door 12 is prevented. Accordingly, the push rod 22 may gradually stop, rattling of the door 12 caused by the inertial rotation of the door 12 and noise caused by collision of the door 12 and the push rod 22 are prevented.

However, the present embodiment is not limited thereto, and the controller 60 may control the rotation speed of the motor 62 so as to incrementally reduce a moving speed of the push rod 22. That is, the controller 60 may incrementally reduce a velocity of the motor 62.

Moreover, the controller 60 may determine whether the push rod 22 reaches the door opening position (S20).

For example, while the motor is rotating in the first direction, the controller 60 may determine whether the accumulated number of rotations of the motor 62 reaches a third reference rotation number.

When it is determined (S20) that the accumulated number of rotations of the motor 62 reaches the third reference rotation number, the controller 60 may determine that the push rod 22 moves to the door opening position and may stop the rotation of the motor 62 (S21).

In the present embodiment, the controller 60 may determine whether the motor 62 operates normally, power is transferred, or the push rod 22 moves normally, based on the number of rotations sensed while the motor 62 is operating.

For example, when the number of rotations (or the number of pulses) sensed for a unit time is smaller than a limitation rotation number (or a limitation pulse number), the motor 62 may be in an abnormal state, or the power transfer device or the push rod 22 cannot normally operate due to an obstacle or an external load.

In this case, when the motor 62 operates continuously, the push rod 22 or the power transfer device can be damaged, or the motor 62 can be broken down by an overcurrent of the motor 62.

Therefore, when the number of rotations sensed for a unit time is smaller than the limitation rotation number, the controller 60 may rotate the motor 62 in the second direction opposite to the first direction in order for the push rod 22 to return to the initial position.

A method of accurately returning the push rod 22 to the initial position may be the same as a method of moving the push rod 22 to the initial position after sensing the reference position as described above in the initialization logic.

As in FIG. 8, when the push rod 22 reaches the door opening position, the first cooling compartment door 14 may be opened for example, and in this state, the user may further rotate the first cooling compartment door 14 passively.

Next, the normal return logic of the push rod will be described.

Figure 9:
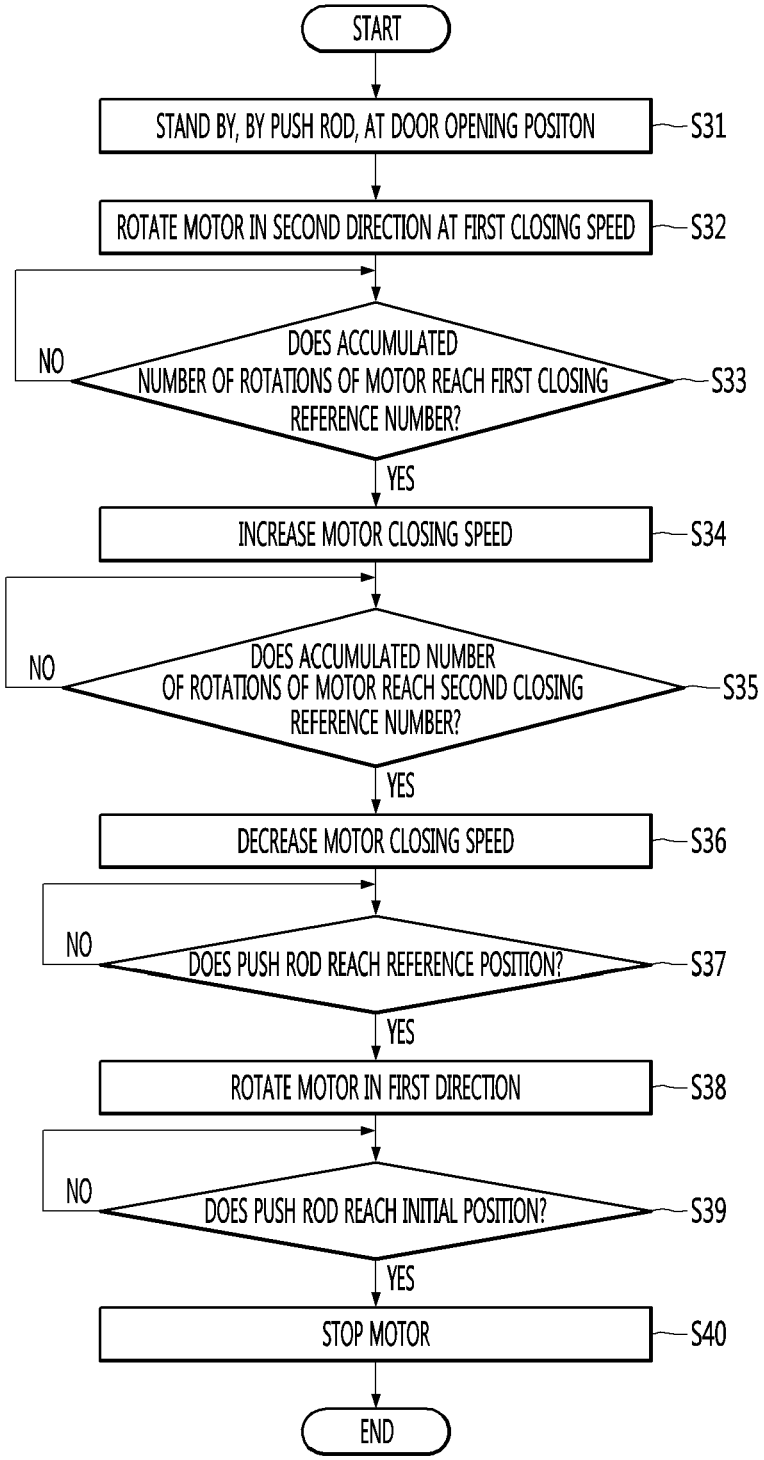
FIG. 9 is a flowchart for describing a return logic of a push rod according to an embodiment of the present invention.
Figure 10:
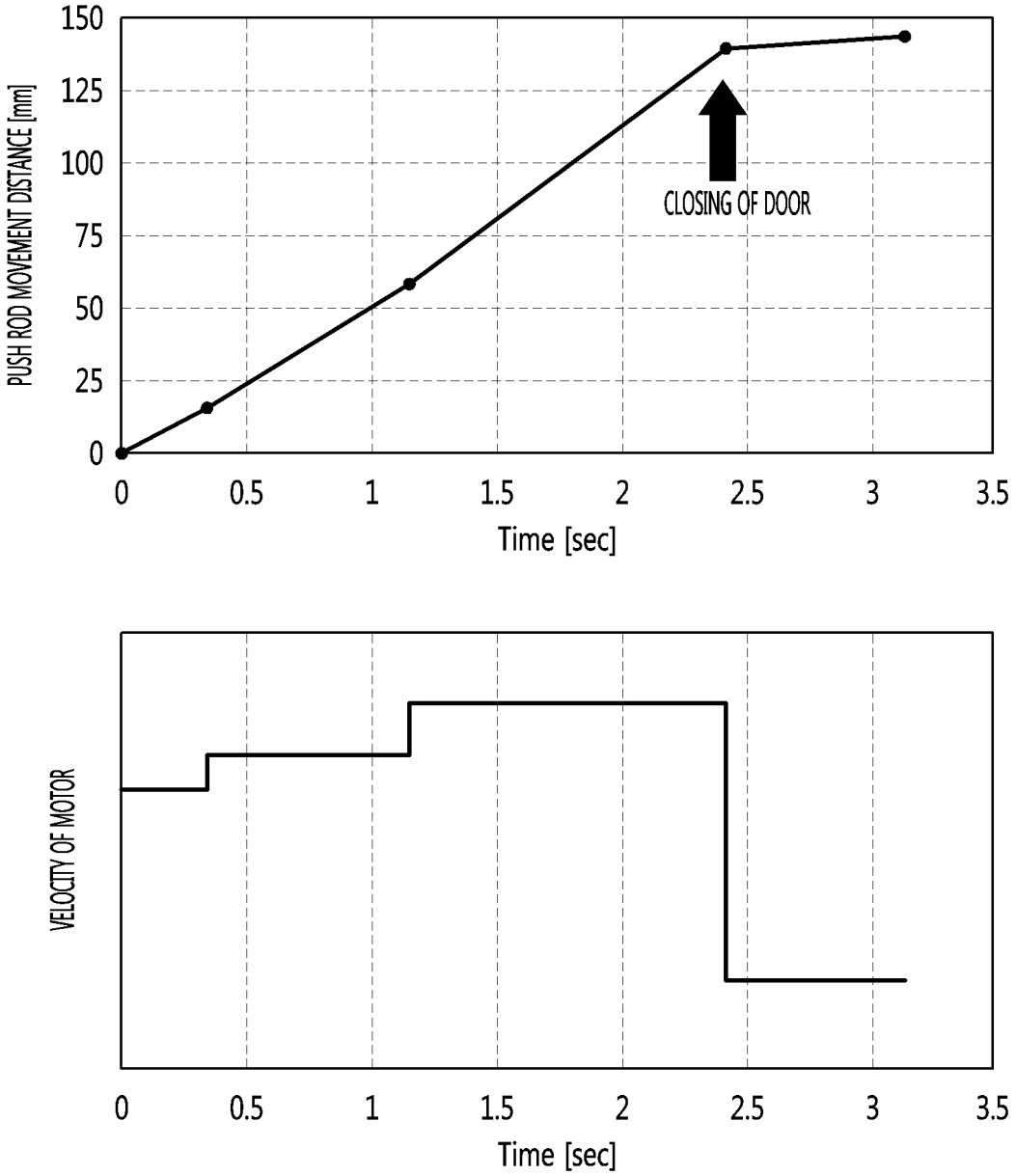
FIG. 10 is a graph illustrating a rotation speed of a motor and a movement distance of a push rod in a return process of the push rod.

FIG. 9 is a flowchart for describing a return logic of a push rod according to an embodiment of the present invention, FIG. 10 is a graph illustrating a rotation speed of a motor and a movement distance of a push rod in a return process of the push rod, and FIG. 11 is a diagram illustrating a position of a push rod until the push rod returns from a door opening position to an initial position.

Referring to FIGS. 9 to 11, opening of the door 12 may be completed, and then, the push rod 22 may stand by at the door opening position (S31).

The controller 60 may determine whether a certain time elapses from a time when the push rod 22 moves to the door opening position and the motor 62 stops.

When it is determined that the certain time elapses from the time when the motor 62 stops, the controller 60 may rotate the motor 62 in the second direction so as to return the push rod 22 to the initial position (S32).

When the motor 62 immediately rotates in the second direction in a state where the push rod 22 reaches the door opening position, the door 12 is immediately closed by one or more of a load of the door 12 itself, a magnetic force of a magnet included in a gasket (not shown) for a close adhesiveness of the door 12 and the cabinet 11, and a closing force generated by an automatic closing mechanism (not shown) which is included in the hinge 30 of the door 12 and allow the door to be automatically closed.

However, as in the present embodiment, when the motor 62 rotates in the second direction after the push rod 22 stands by for a certain time at the door opening position, the door 12 may maintain an opened state for a certain time, and thus, the user may passively and additionally rotate the door 12.

In order to return the push rod to the initial position, the controller 60 may rotate the motor 62 at a first closing speed.

Here, when the first closing speed is set as a fast speed, the push rod 22 may move with the push rod 22 being spaced apart from the door 12 without contacting the door 12, and in this case, a closing noise of the door 12 occurs.

Therefore, the first closing speed may be set lower than the first opening speed and the third opening speed.

In a case where the first closing speed is set as a low speed, when the push rod 22 is loaded into the housing 21, the door 21 may rotate in a clockwise direction with respect to FIG. 8 in a state of contacting the push rod 22.

Moreover, the controller 60 may determine whether the accumulated number of rotations of the motor 62 reaches a first closing reference number (S33).

At this time, while the motor 62 is rotating in the second direction, the rotation sensing unit 63 may sense the number of rotations of the motor 62.

When it is determined (S33) that the accumulated number of rotations of the motor 62 reaches the first closing reference number, the controller 60 may increase a closing speed of the motor 62. For example, the controller 60 may rotate the motor 62 at a second closing speed.

In a case where the first closing speed is initially set as a low speed, when a rotation speed of the motor 62 is maintained as the first closing speed, a closing time of the door 12 may increase. Therefore, after it is determined that the accumulated number of rotations of the motor 62 reaches the first closing reference number, the controller 60 may increase the rotation speed of the motor 62, thereby allowing the closing time of the door 12 to be shortened.

At this time, the controller 60 may incrementally increase a closing speed of the motor 62.

When the accumulated number of rotations of the motor 62 reaches the first closing reference number, an opening angle of the door 12 may be in a reduced state, and thus, even when the closing speed of the door 12 becomes faster, noise occurring a process of closing the door 12 is not large.

While the motor 62 is rotating in the second direction, the controller 60 may determine whether the accumulated number of rotations of the motor 62 reaches a second closing reference number (S35).

When it is determined (S35) that the accumulated number of rotations of the motor 62 reaches the second closing reference number, the controller 60 may decrease the rotation speed of the motor 62 (S36).

In a state where the accumulated number of rotations of the motor 62 reaches the second closing reference number, the door 12 may be in a closed state, and the push rod 22 may be in a state of contacting the door 12 or a state of being spaced apart from the door 12.

As described above with reference to FIG. 5, the push rod 22 may move to the reference position, and then, may move to the initial position.

In the present embodiment, the push rod 22 should contact the stopper 22*a*, and thus, if a moving speed of the push rod 22 is fast, noise caused by collision of the push rod 22 and the stopper 22*a* is large.

Therefore, in the present embodiment, the controller 60 may decrease the rotation speed of the motor 62 before the push rod 22 moves to the reference position, and thus, noise caused by collision of the push rod 22 and the stopper 22*a* is minimized.

When the rotation speed of the motor 62 is reduced, a moving speed of the push rod 22 is reduced.

Moreover, the controller 60 may determine whether the push rod 22 reaches the reference position (S37).

When the number of rotations of the motor 62 for a unit time is equal to or less than a stop reference number, the controller 60 may determine that the push rod 22 has moved to the reference position and may again rotate the motor 62 in the first direction (S38) (see FIG. 11 (*c*)).

While the motor 62 is rotating in the first direction, the controller 60 may determine whether the push rod 22 reaches the initial position (S39).

For example, when the accumulated number of rotations reaches a predetermined rotation number while the motor 62 is rotating in the first direction, the controller 60 may determine that the push rod 22 has moved to the initial position and may stop the motor 62 (S40) (see FIG. 11 (*d*)).

Next, the urgent return logic of the push rod will be described.

Figure 12:
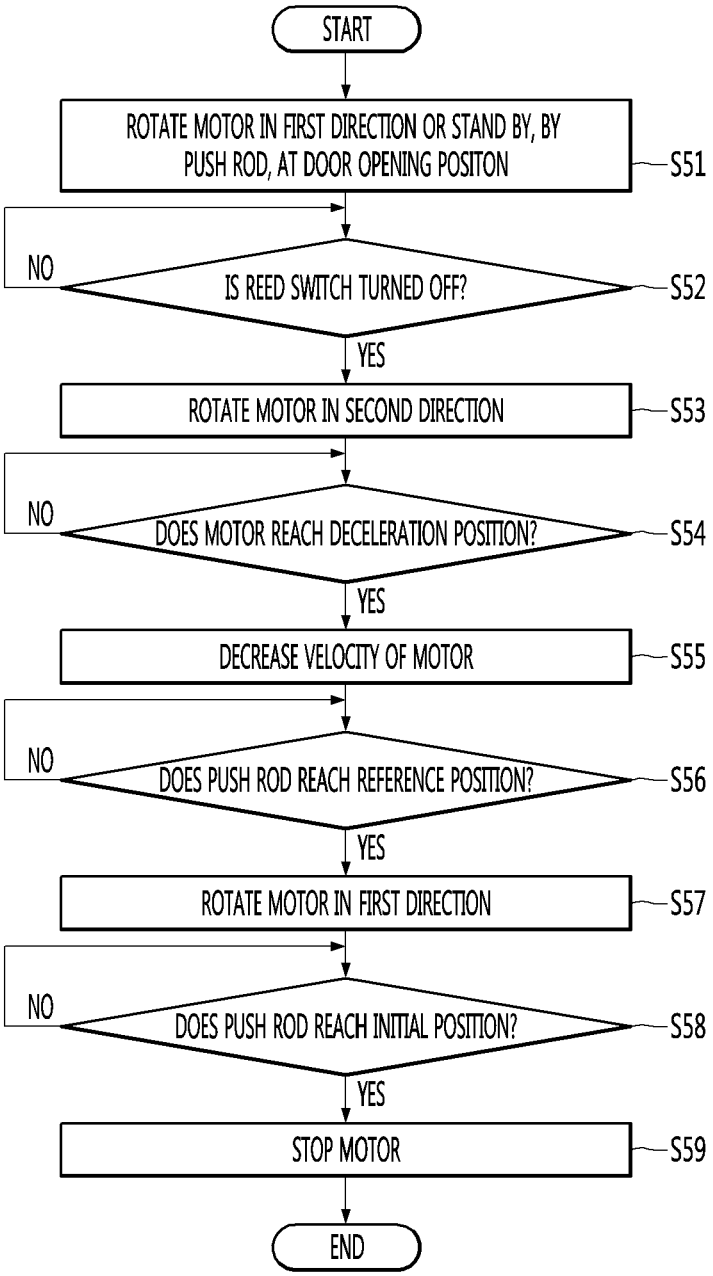
FIG. 12 is a flowchart for describing an urgent return logic of a push rod according to an embodiment of the present invention.

FIG. 12 is a flowchart for describing an urgent return logic of a push rod according to an embodiment of the present invention.

Referring to FIGS. 3 and 12, the motor 62 may rotate in the first direction for opening the door 12. Also, in a state where the opening of the door 12 is completed, the push rod 12 may stand by at the door opening position (S51).

As described above, while the motor 62 is rotating in the first direction or the push rod 22 stands by at the door opening position, the user may passively rotate the door 12.

In this state, the controller 60 may determine whether the reed switch 44 is turned off (S52). As described above, when the reed switch 44 is turned off, this may be a case where the user passively opens the door 12, and thus, the push rod 22 is spaced apart from the reed switch 44 by a certain distance.

When it is determined (S52) that the reed switch 44 is turned off, the controller 60 may rotate the motor 62 in the second direction so as to return the push rod 22 to the initial position (S53).

In the present embodiment, while the motor 62 is rotating in the first direction, a protrusion length of the push rod 22 from the housing 21 may increase. Alternatively, in a state where the push rod 22 is located at the door opening position, the protrusion length of the push rod 22 may be the maximum.

For example, the door 12 may rotate in a closing direction in a state where the door 12 has passively rotated by the user in a direction increasing an opening angle in a state where the push rod 22 has protruded from the housing 21. In this case, the door 12 collides with the push rod 12, and due to this, the push rod 22 or the door 12 is damaged, causing damage of gears configuring the power transfer device.

In this case, as an opening angle of the door 12 increases, an impact force which is applied to the push rod 22 when the door 12 is closed is large. Also, as the protrusion length of the push rod 22 increases, a damage possibility of the push rod 22 increases.

Therefore, in the present embodiment, in order to prevent the push rod 22, the door 12, and the gears configuring the power transfer device in a process where the door 12 is opened and then closed by the user in a state where the push rod 22 has protruded, when the reed switch 44 is turned off, the controller 60 may rotate the motor 62 in the second direction so as to urgently return the push rod 22 to the initial position.

At this time, the controller 60 may rotate the motor 62 at an urgent closing speed.

The urgent closing speed may be set faster than the second closing speed described above with reference to FIG. 9. This is because a damage possibility of the push rod 22 is larger than a case where the push rod 22 normally returns to the initial position, and thus, the push rod 22 should quickly return to the initial position.

While the motor 62 is rotating in the second direction, the controller 60 may determine whether the push rod 22 reaches a deceleration position of the motor 62 (S54).

When it is determined (S54) that the push rod 22 reaches the deceleration position of the motor 62, the controller 60 may reduce a rotation speed of the motor 62 (S55).

In the present embodiment, the number of rotations of the motor 62 may be accumulated while the motor 62 is rotating in the first direction in a state where the motor 62 stops, the accumulated number of rotations (a first accumulation rotation number) may be stored in the memory 61.

When the motor 62 rotates in the second direction for the urgent return of the push rod 22, the number of rotations (a second accumulation rotation number) of the motor 62 may be accumulated at a time when the motor 62 starts to rotate in the second direction.

Moreover, a difference value between the first accumulation rotation number and the second accumulation rotation number may be calculated and stored in the memory 61.

Moreover, if the difference value between the first accumulation rotation number and the second accumulation rotation number reaches a deceleration reference accumulation number, the controller 60 may determine that the push rod 22 reaches the deceleration position of the motor 62.

A position of the push rod 22 when the difference value reaches the deceleration reference accumulation number may be a position which is spaced apart from the reference position, and may be a position which contacts or is spaced apart from the door 12.

The position of the push rod 22 when the difference value reaches the deceleration reference accumulation number may be equal to or different from a position when the accumulated number of rotations of the motor 62 reaches the second closing reference number in FIG. 9.

As described above, when the rotation speed of the motor 62 is reduced before the push rod 22 reaches the reference position, noise caused by collision of the push rod 22 and the stopper 22*a* is minimized.

Moreover, the controller 60 may determine whether the push rod 22 reaches the reference position (S56).

When the number of rotations of the motor 62 for a unit time is equal to or less than the stop reference number, the controller 60 may determine that the push rod 22 has moved to the reference position and may again rotate the motor 62 in the first direction (S57).

While the motor 62 is rotating in the first direction, the controller 60 may determine whether the push rod 22 reaches the initial position (S58).

For example, when the accumulated number of rotations reaches the predetermined rotation number while the motor 62 is rotating in the first direction, the controller 60 may determine that the push rod 22 has moved to the initial position and may stop the motor 62 (S59).

According to the proposed embodiments, the number of rotations of a motor may be sensed without a sensor for sensing a position of a push rod, and thus, a position of the push rod operating for opening a door may be accurately controlled.

Moreover, according to the present embodiment, when the push rod is unloaded for opening the door, a velocity of the motor may be reduced before the push rod contacts the door or a cabinet, and thus, noise caused by collision of the push rod and the door or the cabinet is minimized.

Moreover, according to the present embodiment, since the velocity of the motor is reduced before opening of the door of the refrigerator is completed, rattling of the door of the refrigerator corresponding to a phenomenon where the door of the refrigerator inertially rotates and then contacts the push rod is removed, and moreover, noise caused by the rattling is removed.

Moreover, according to the present embodiment, a moving speed of the push rod may be reduced at an initial return stage of the push rod, and thus, the door may be closed in a state where the push rod contacts the door. Accordingly, a phenomenon where the push rod is spaced apart from the door is prevented, and thus, noise caused by collision after the push rod is spaced apart from the door is removed.

Moreover, according to the present embodiment, when power is applied to the refrigerator or when the power is applied after a power cut, the push rod may move to a reference position, and then, may move to an initial position, whereby the push rod may move to the initial position even without a separate sensor for sensing a position of the push rod.

It will be apparent to those skilled in the art that various modifications and variations can be made in the present invention without departing from the spirit or scope of the disclosures. Thus, it is intended that the present invention covers the modifications and variations of this disclosure provided they come within the scope of the appended claims and their equivalents.

What is claimed is:

1. A refrigerator comprising:

a cabinet that includes a storage compartment;

a door configured to open and close the storage compartment;

a door opening device that includes (i) a push rod configured to move from an initial position to a door opening position for opening the door, and (ii) a motor configured to provide power to move the push rod; and a controller configured to control the motor by:

achieving a rotation speed of the motor at a first opening speed to open the door of the refrigerator;

decreasing, based on the rotation speed of the motor achieving the first opening speed and before the push rod contacts the door of the refrigerator or the cabinet, the rotation speed of the motor from the first opening speed to a second opening speed lower than the first opening speed; and increasing, after the push rod contacts the door of the refrigerator or the cabinet, the rotation speed of the motor from the second opening speed to a third opening speed greater than the second opening speed.

2. The refrigerator of claim 1, further comprising a rotation sensing unit configured to sense a number of rotations of the motor, wherein the controller is configured to decrease the rotation speed of the motor from the first opening speed to the second opening speed before the push rod contacts the door of the refrigerator or contacts the cabinet by:

based on the motor rotating at the first opening speed and based on a first accumulated number of rotations of the motor reaching a first opening reference rotation number, decreasing the rotation speed of the motor from the first opening speed to the second opening speed.

3. The refrigerator of claim 2, wherein the controller is configured to increase the rotation speed of the motor from the second opening speed to the third opening speed after the push rod contacts the door of the refrigerator or contacts the cabinet by:

based on the motor rotating at the second opening speed for at least a predetermined period of time, increasing the rotation speed of the motor from the second opening speed to the third opening speed.

4. The refrigerator of claim 2, wherein the controller is configured to decrease the rotation speed of the motor from the first opening speed to the second opening speed before the push rod contacts the door of the refrigerator or contacts the cabinet by:

decreasing the rotation speed of the motor before the push rod moves to the door opening position.

5. The refrigerator of claim 4, wherein the controller is configured to decrease the rotation speed of the motor from the first opening speed to the second opening speed before the push rod contacts the door of the refrigerator or contacts the cabinet by:

based on the first accumulated number of rotations of the motor reaching a second opening reference rotation number greater than the first opening reference rotation number after the motor starts to operate, decreasing the rotation speed of the motor.

6. The refrigerator of claim 5, wherein the controller is further configured to stop the rotation of the motor based on the push rod moving to the door opening position by:

stopping the rotation of the motor based on the first accumulated number of rotations of the motor reaching a third opening reference rotation number greater than the second opening reference rotation number after the motor starts to operate.

7. The refrigerator of claim 1, wherein the third opening speed is set to be greater than the first opening speed.

8. The refrigerator of claim 1, wherein the controller is further configured to:

in a state in which the push rod is in the door opening position, move the push rod from the door opening position back to the initial position by (i) rotating the motor at a first closing speed, (ii) subsequently increasing the rotation speed of the motor from the first closing speed to a second closing speed greater than the first closing speed, and (iii) before the push rod moves back to the initial position from the door opening position, decreasing the rotation speed of the motor from the second closing speed.

9. The refrigerator of claim 8, further comprising a rotation sensing unit configured to sense a number of rotations of the motor, wherein increasing the rotation speed of the motor from the first closing speed to the second closing speed comprises:

based on the motor rotating at the first closing speed and based on a second accumulated number of rotations of the motor reaching a first closing reference number, increasing the rotation speed of the motor from the first closing speed to the second closing speed.

10. The refrigerator of claim 8, wherein the controller is further configured to:

determine whether the push rod reaches a reference position; and based on the push rod reaching the reference position, changing a rotation direction of the motor.

11. The refrigerator of claim 10, wherein the controller is configured to determine whether the push rod reaches the reference position by:

determining whether a number of rotations of the motor during a time period is less than or equal to a stop reference number.

12. The refrigerator of claim 10, wherein the controller is further configured to stop the rotation of the motor based on the push rod moving from the door opening position back to the initial position by:

stopping the rotation of the motor based on a third accumulated number of rotations of the motor reaching a predetermined rotation number after changing the rotation direction of the motor.

13. The refrigerator of claim 1, wherein the controller is further configured to:

based on power being applied to the refrigerator, rotating the motor in a first direction in which the push rod moves from the door opening position back to the initial position;

based on the push rod reaching a reference position, changing a rotation direction of the motor to a second direction; and based on the push rod reaching the initial position, stopping the rotation of the motor.

14. The refrigerator of claim 13, wherein the controller is configured to determine that the push rod reaches the reference position by:

based on the motor rotating in the first direction and based on a number of rotations of the motor for a time period being less than or equal to a stop reference number, determining that the push rod reaches the reference position.

15. The refrigerator of claim 13, wherein the controller is configured to determine that the push rod reaches the initial position by:

based on a third accumulated number of rotations of the motor reaching a predetermined rotation number after changing the rotation direction of the motor, determining that the push rod reaches the initial position.

* * * * *